US006692322B1

(12) United States Patent
Heatherly

(10) Patent No.: US 6,692,322 B1
(45) Date of Patent: Feb. 17, 2004

(54) FLOTATION DEVICE FOR WATER ACTIVITIES

(76) Inventor: David Heatherly, 965 W. 3rd Ave., Apache Junction, AZ (US) 85220

( * ) Notice: Subject to any disclaimer, the term of this patent is extended or adjusted under 35 U.S.C. 154(b) by 0 days.

(21) Appl. No.: 10/226,866

(22) Filed: Aug. 24, 2002

(51) Int. Cl.[7] ..... B63C 9/08

(52) U.S. Cl. ..... 441/132; 441/129; 441/120

(58) Field of Search ..... 441/88, 106, 108, 441/120, 125, 126, 127, 129, 130, 132; 472/13, 128, 129; 482/111, 142; D21/803, 804, 805

(56) References Cited

U.S. PATENT DOCUMENTS

| | | | | | |
|---|---|---|---|---|---|
| 728,745 | A | * | 5/1903 | Morrison | 441/115 |
| 1,217,824 | A | | 2/1917 | Pritchard | |
| 1,803,095 | A | * | 4/1931 | Cole | 441/120 |
| 2,197,324 | A | | 4/1940 | Sommers et al. | |
| D255,966 | S | * | 7/1980 | Stadel | D6/604 |
| 4,379,704 | A | | 4/1983 | Rademacher | |
| D280,005 | S | * | 8/1985 | Jones | D21/805 |
| 4,580,988 | A | * | 4/1986 | Correll | 441/130 |
| 4,861,300 | A | | 8/1989 | Casagrande | |
| D310,700 | S | * | 9/1990 | Jones | D21/805 |
| 4,986,786 | A | * | 1/1991 | Helt et al. | 441/120 |
| D344,120 | S | * | 2/1994 | Helt et al. | D21/804 |
| 5,443,409 | A | * | 8/1995 | Adamson | 441/130 |
| D363,968 | S | * | 11/1995 | Koellner | D21/678 |
| 5,516,320 | A | * | 5/1996 | LaPlant | 441/106 |
| 5,562,514 | A | * | 10/1996 | Rowe | 441/130 |
| 5,685,753 | A | * | 11/1997 | Canela et al. | 441/129 |
| D387,838 | S | * | 12/1997 | Canela et al. | D21/803 |
| 5,921,898 | A | * | 7/1999 | McDonald | 482/111 |
| 6,056,613 | A | | 5/2000 | Pike | |

FOREIGN PATENT DOCUMENTS

| | | | | |
|---|---|---|---|---|
| JP | 09136691 | A * | 5/1997 | B63C/9/08 |

OTHER PUBLICATIONS

Avon Wellness—Campaign 16,2002–Campaign 18, 2002 Avon Products, ¯Inc., 1251 Avenue of The Americas New York, NY 10020 "New AquaJogger".

* cited by examiner

*Primary Examiner*—S. Joseph Morano
*Assistant Examiner*—Ajay Vasudeva
(74) *Attorney, Agent, or Firm*—John D. Lister

(57) ABSTRACT

A flotation device to be worn for water activities includes first and second buoyant end portions and a clamping member that may be multi-sectional. The clamping member passes from an abdominal region of a user between the user's legs to a back region of a user and is used to move the buoyant portions toward and away from each other to clamp the flotation device to and unclamp the flotation device from the abdominal and back regions of a user's trunk. Preferably, the flotation device includes one or two connectors for connecting the flotation device to a tether so that a user of the flotation device can swim in place when wearing the flotation device.

20 Claims, 4 Drawing Sheets

FIG. 15
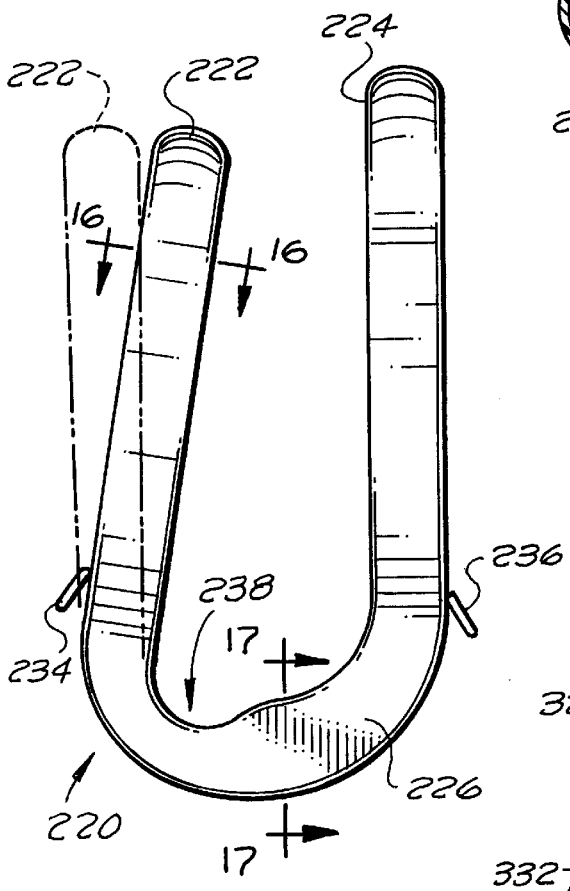
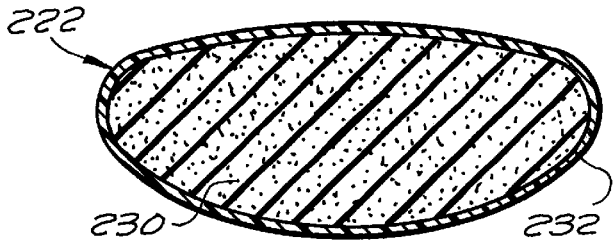
FIG. 16
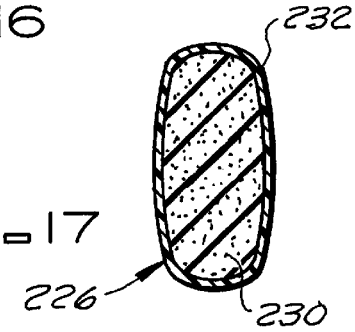
FIG. 17
FIG. 18
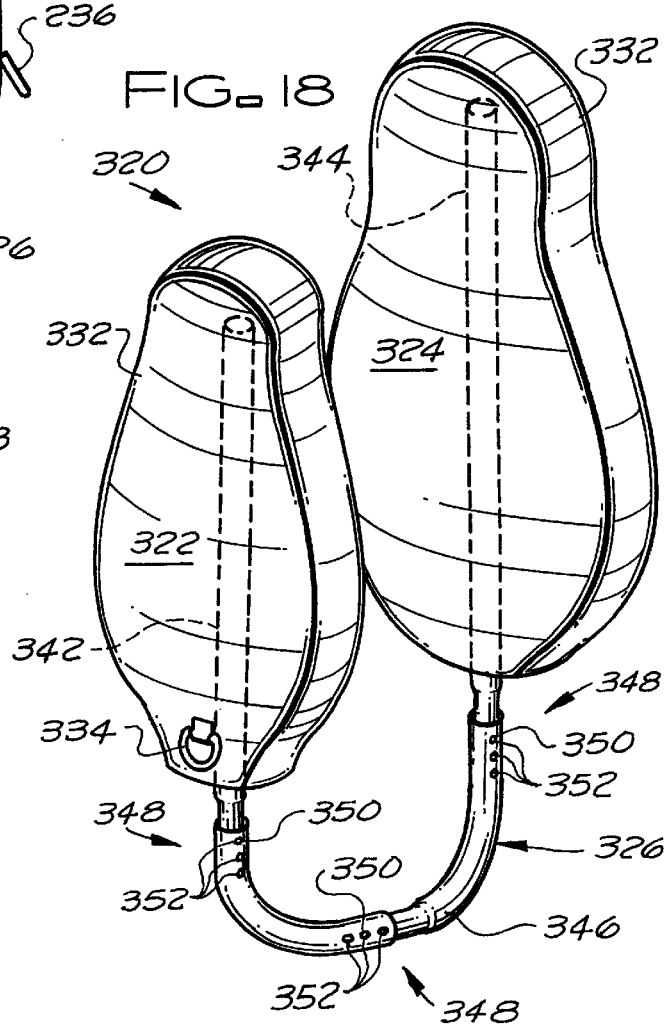
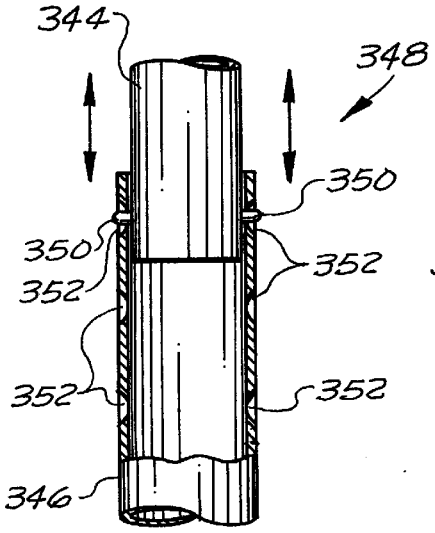
FIG. 19

FLOTATION DEVICE FOR WATER ACTIVITIES

BACKGROUND OF THE INVENTION

The subject invention relates to a personal flotation device and in particular to a flotation device that does not interfere with a person's use of his/her arms and/or legs and that accordingly can be worn by a person while performing any of numerous water activities, such as but not limited to swimming, competitive swim training, physical therapy, general physical fitness, aerobics, and various recreational activities.

Water activities are a satisfying and healthy way to achieve physical fitness and promote mental well-being. Swimming and other water related activities can be performed by persons of all ages and by persons with physical handicaps that would otherwise prevent them from participating in physical activities. Water activities that promote physical and mental well being include but are not limited to competitive and recreational swimming, training and conditioning for competitive and recreational swimming, water aerobic and strength training, water therapy for physical handicaps and rehabilitation from injuries or surgery, water games, and various other recreational activities.

Willibald Nagler, M. D., F.A.C.P., of The New York Hospital Cornell Medical Center, stated in the foreword to "SWIMMING FOR TOTAL FITNESS" written by Jane Katz Ed. E. and copyrighted in 1981:

"Swimming has many advantages over other sports. Most aerobic activities (that is, those that make us out of breath), such as jogging, tennis, climbing, and aerobic dancing, place stress on the weight-bearing joints and the lumbar spine. Swimming, on the other hand, gives an aerobic effect with less stress to the joints. In addition, moving the arms and legs against the resistance of the water is the equivalent of exercising with weights, but since water doesn't allow any sudden, harmful movements, the risk of injury is lowered. Also, swimming exercises both sides of the body equally. Out of water, only cross-country skiing even approaches this symmetrical effect.

Although swimming is ideal for people of any age, it is particularly beneficial for the older person. By the age of sixty or seventy, many people who are in otherwise excellent health are hampered in sports by minor hypertrophic arthritic changes in the spine and the weight-bearing joints, which can make it rather difficult to jog, play tennis, or take part in other sporting activities. For these people, swimming is an excellent way to reap the aerobic benefits of running or tennis without incurring any pain. In the water, the weight-bearing stress of the vertical position is eliminated, there is is less stress on the joints during the contraction of muscles, and what stress there is distributed equally throughout the joints. For these reasons swimming is a very useful therapeutic activity for many locomotion problems. In fact, the swimmer can do much by himself to contribute to his own rehabilitation, thereby often shortening an otherwise long and expensive process."

Thus, water activities such as swimming, water aerobics, hydro calisthenics, water therapy, water fitness training as well as various recreational activities can be very beneficial to persons of all ages and can be particularly beneficial to a person of any age rehabilitating from an injury and/or surgery. It is an object of the subject invention to provide a personal flotation device that does not interfere with the person's use of his/her arms and legs and that facilitates the participation by most persons in water activities regardless of age, disabilities, fear of the water, or injuries. It is a another object of the subject invention to provide a personal flotation device that is inexpensive, easy to put on and remove, comfortable to wear and that, in addition to use in connection with therapeutic, hydro calisthenic, physical fitness training, instructional training, competitive swimming training, aerobic, and weight control and muscle building activities, can be used recreationally. It is a further object to use the personal flotation device of the subject invention to create more ideal and relaxed conditions for the participation by individuals in the various water activities mentioned above and to motivate and immerse such individuals into participation in what many experts refer to as natures perfect exercise (swimming and hydro calisthenics).

SUMMARY OF THE INVENTION

The flotation device of the subject invention can be worn while performing any of the water activities discussed above and should provide a low cost versatile and effective flotation aid to use when performing water activities such as swimming, competitive swim training, swimming instruction, hydro calisthenics, physical therapy, physical fitness, aerobics, and various recreational and other water activities. The flotation device of the subject invention includes buoyant portions at each end that are joined by a clamping member that clamps the flotation device to the user. Preferably, the portion of the flotation device between the buoyant end portions of the flotation device is also buoyant, but it is not necessary that the portion of the flotation device intermediate the buoyant end portions of the flotation device be buoyant, e.g. the buoyancy of the portion of the flotation device intermediate the buoyant end portions of the flotation device may be neutral having the same or substantially the same specific gravity as water.

When the flotation device of the subject invention is worm, the clamping member passes from an abdominal region of a user between the user's legs to a back region of the user. The flotation device can be easily and quickly put on by passing a middle portion the clamping member between the user's legs and bringing the buoyant end portions of the flotation device into contact with an abdominal region and a back region of the user. With the flotation device in place, the clamping member presses the buoyant end portions of the flotation device against the abdominal and back regions of a user's trunk to clamp the flotation device to the user's trunk and hold the flotation device in place while the user performs water activities. The clamping member also permits the buoyant end portions of the flotation device to be moved away from each other to unclamp the flotation device from a user's trunk so that the user can easily and quickly remove the flotation device when he/she has completed his/her water activity.

Preferably, the buoyant end portions of the flotation device of the subject invention are centered on regions of the user's abdomen and back and do not extend laterally beyond the person's trunk. With the buoyant end portions of the flotation device not extending laterally beyond the user's trunk; with the clamping member passing between the user's legs; and with no shoulder straps, waist straps or other encumbering harnesses or fastening means required to mount the flotation device on the user, the flotation device of the subject invention does not interfere with a person's use of his/her arms and/or legs during use of the flotation device for swimming, competitive or recreational swim training, physical therapy, physical fitness, aerobics, recreation or various other water activities.

Preferably, the flotation device of the subject invention also includes one or two connectors for connecting the flotation device to a tether so that a person using the flotation device can swim in place when wearing the flotation device. With the flotation device clamped to a swimmer and tethered to the end or side of a pool, the flotation device will maintain the swimmer in a fixed position as he/she swims and the swimmer can perform the same swimming exercises in a small backyard pool that would normally require the use of a much larger pool such as an olympic size pool. Since the flotation device of the subject invention does not interfere with the use of the person's arms or legs, the user can do any of the normal swimming strokes, such as but not limited to the crawl stroke, backstroke, breaststroke, butterfly stroke, and side stroke, plus any other stroke or exercise that comes to mind.

BRIEF DESCRIPTION OF THE DRAWINGS

FIG. 15 is a side view of a third version of the flotation device of the subject invention showing the flotation device in an unstressed state and, in phantom line, in a stressed state with the buoyant flotation portions of the flotation device spread apart.

FIG. 16 is a cross section of the flotation device of FIG. 15 taken substantially along lines 16—16 FIG. 15.

FIG. 17 is a cross section of the flotation device of FIG. 15 taken substantially along lines 17—17 of FIG. 15.

FIG. 18 is a perspective view of a fourth embodiment of the flotation device the subject invention.

FIG. 19 is an enlarged view, partially in section, of a coupling or fastening mechanism used in the flotation device of FIG. 18.

DESCRIPTION OF THE PREFERRED EMBODIMENTS

Figure 1:
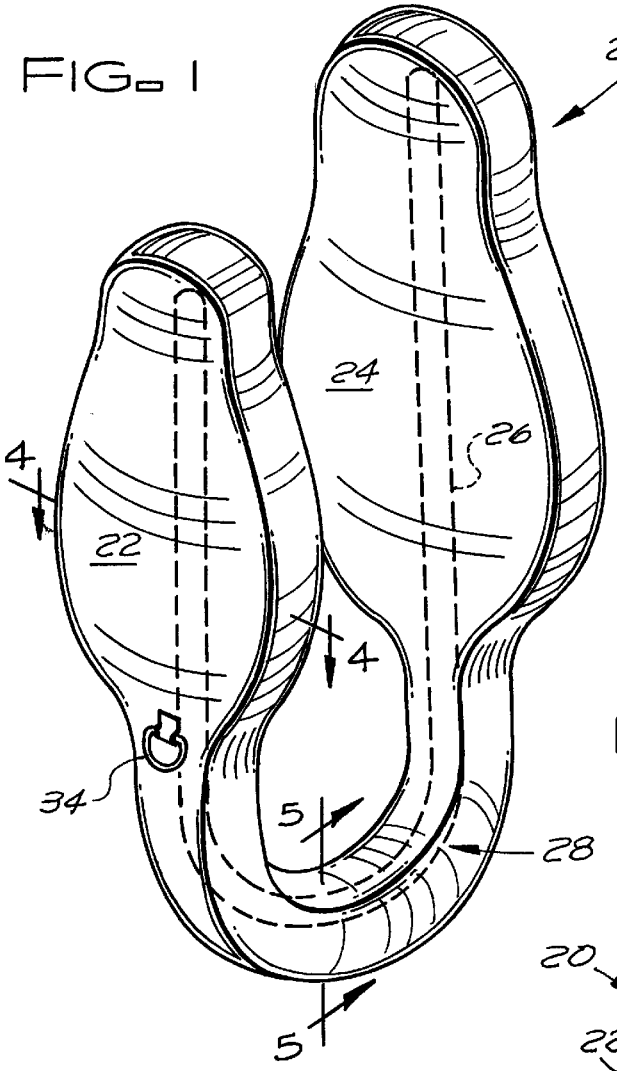
FIG. 1 is a perspective view of a first embodiment of the flotation device the subject invention.
Figure 2:
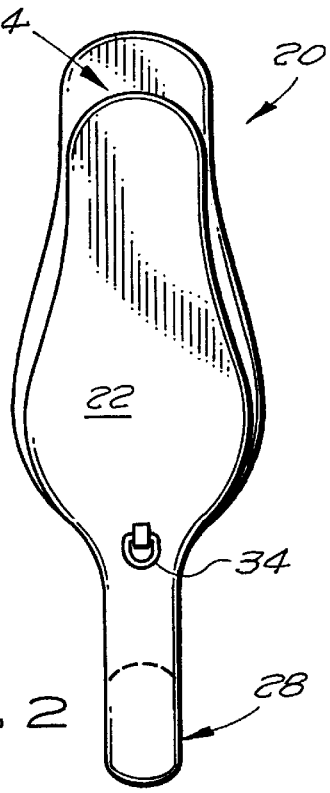
FIG. 2 is a front view of the first embodiment of the flotation device the subject invention.
Figure 3:
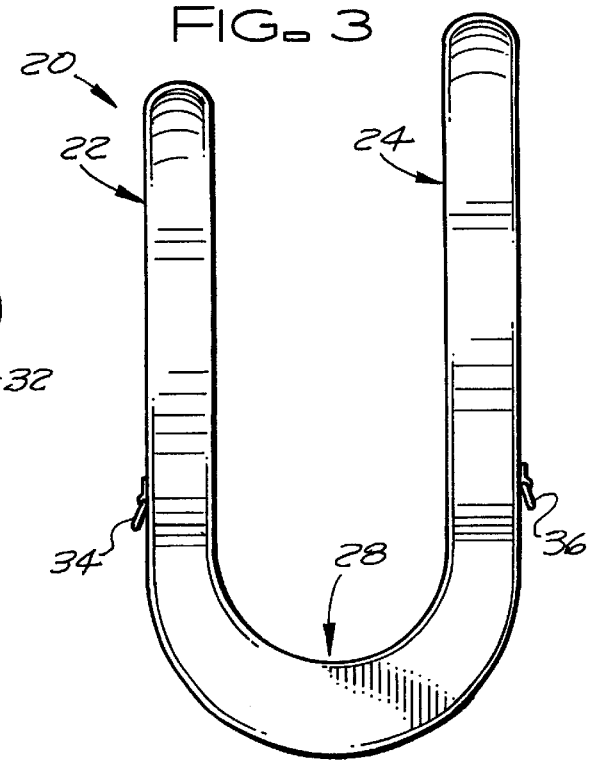
FIG. 3 is a side view of the first embodiment of the flotation device the subject invention.
Figure 4:
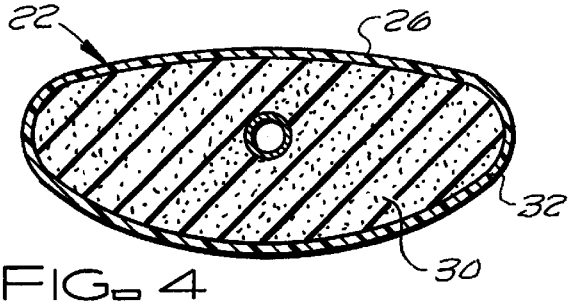
FIG. 4 is a horizontal cross section through the flotation device of FIGS. 1 to 3 taken substantially along lines 4—4 of FIG. 1.
Figure 5:
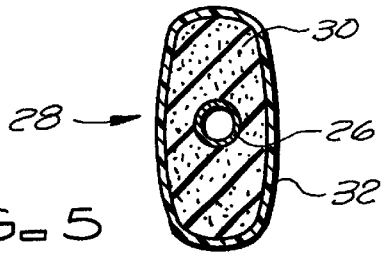
FIG. 5 is a vertical cross section through the flotation device of FIGS. 1 to 3 taken substantially along lines 5—5 of FIG. 1.

FIGS. 1 to 5 show a first embodiment 20 of the subject invention. The flotation device 20 is generally U-shaped and includes buoyant portions 22 and 24 at each end and a generally U-shaped clamping member 26 that extends between and into each buoyant end portion so that the buoyant portions 22 and 24 move with the arms of clamping member. When the flotation device 20 is worm, the clamping member 26 passes between the upper portions of the user's legs and presses the buoyant end portions 22 and 24 against an abdominal region and a back region of the user's body to thereby clamp the flotation device 20 to the user's body and hold the flotation device in place so that the user can perform various water activities while wearing the flotation device. Since the clamping member 26 extends between the buoyant end portions 22 and 24, the clamping member 26 forms a middle portion 28 or, if the middle portion is padded as shown in FIG. 5, a core of a middle portion 28 of the flotation device 20.

Preferably, the buoyant end portions 22 and 24 of the flotation device 20 are made of a buoyant material 30 that is both deformable and resilient, such as but not limited to a deformable and resilient foam flotation material, With the buoyant end portions made of a deformable material, when the flotation device 20 is worm, the buoyant end portions 22 and 24 of the flotation device 20 conform to the contours of the user's body as the buoyant end portions are pressed against the user's body by the clamping member 26 for the user's comfort and enhanced gripping. With the buoyant end portions 22 and 24 made of a deformable and resilient material, when the flotation device 20 is worm, the buoyant end portions 22 and 24 of the flotation device 20 conform to the contours of the user's body as the buoyant end portions are pressed against the user's body by the clamping member 26 for the user's comfort and enhanced gripping and readily return to their original shapes when the flotation device 20 is removed. When the middle portion 28 of the flotation device 20 is padded, preferably, the middle portion 28 of the flotation device is padded with the same buoyant material 30 that is used in the buoyant end portions 22 and 24 of the flotation device. While not a preferred embodiment of the invention, it is also contemplated that the buoyant end portions 22 and 24 could be inflated flotation elements, e.g. inflatable and deflatable airtight bags made of rubber or some other deformable and pliable polymeric material.

The lengths, widths and thicknesses of the buoyant end portions 22 and 24 of the flotation device 20 may be varied to provide the buoyancy desired. The flotation device 20 may come in one or more sizes. For example, one model of the flotation device 20 will be sized or dimensioned to fit an adult having an average size trunk (i.e. a trunk of average length, width and thickness from front to back) with the middle portion 28 of the flotation device spaced a selected distance (e.g. about 1 to about 3 inches below the crotch) below the person's crotch when the buoyant end portions 22 and 24 of the flotation device are located over the desired abdominal and back regions for clamping. Since for a person with an average size trunk there is a spacing between the middle portion 28 of the flotation device 20 and the user's crotch, by varying the spacing between the middle portion 28 of the flotation device and a person's crotch, persons having longer or shorter trunk lengths can also wear the same flotation device 20 and still locate the buoyant end portions over the desired abdominal and back regions for clamping. In addition, since a person using the flotation device 20 can adjust the placement of the front and rear buoyant end portions 22 and 24 of the flotation device on his/her trunk by varying the spacing between the middle portion 28 of the flotation device and his/her crotch, if desired for comfort or other reasons, a user can vary the placement of the buoyant end portions 22 and 24 on his/her body by varying the spacing between the middle portion 28 of the flotation device and his/her crotch. Preferably, the maximum widths of the buoyant end portions 22 and 24 would be sized (e.g. typically about 10 inches wide or less) to keep the buoyant end portions 22 and 24 of the flotation device 20 from extending laterally beyond the user's trunk when the flotation device is centered on the trunk of the user so that the flotation device does not interfere with the movement of a persons limbs when wearing the flotation device. If desired, other models of the flotation device 20 can be sized in the same way to be worn by children of a selected age with average size trunks, adult males with average size trunks, adult females with average size trunks, or to be worn by adults with abnormally long or short trunks.

Preferably, the buoyant end portions 22 and 24 and the middle portion 28 of the flotation device 20 are completely encased within an outer flexible covering layer 32 that provides a smooth, non-irritating surface for contact with the user's skin. The covering layer 32 may be made of various materials and preferably, is water impervious to enhance the buoyancy of the flotation device over long periods of use. For example, the covering layer 32 may be a flexible water impervious skin layer formed by heat on and integral with the foam flotation material, a flexible water impervious polymeric film layer, or a fabric layer e.g. a nylon fabric layer.

The clamping member 26 has a generally U-shaped configuration or can be formed into a generally U-shaped configuration with front and back arms when the flotation device 20 is to be worn and permits the buoyant end portions 22 and 24 of the flotation device 20 to be moved toward and away from each other between a first position where the clamping member presses the buoyant end portion 22 against an abdominal region of the user and presses the buoyant end portion 24 against a back region of the user to clamp the flotation device to the user's trunk and a second position to unclamp the flotation device from the user's trunk. For example, the clamping member 26 of the flotation device 20 may be a pliable member, an articulated member, or a resilient member. When the clamping member 26 is a pliable member or an articulated member, preferably, the clamping member can be straightened from its generally U-shaped configuration for easier storage of the flotation device and reshaped to the generally U-shaped configuration when the flotation device 20 is to be worn. When the clamping member 26 is a resilient member, the clamping member retains its generally U-shaped configuration even when not being worn.

When the clamping member 26 of the flotation device 20 is a pliable clamping member, with the pliable clamping member 26 in its normal U-shaped configuration, the buoyant portions 22 and 24 at the first and second ends of the flotation device 20 can be repeatedly moved toward and away from each other to selected positions and retained in the selected positions to clamp the flotation device 20 to and unclamp the flotation device 20 from a user's trunk. The pliable clamping member 26 may be made from a solid rod-shaped member, a tubular member (as shown in FIGS. 4 and 5), or a narrow flat strip member. By way of example, in a prototype of the flotation device 20, a copper tube was used for the clamping member 26. The copper tubing enabled the buoyant end portions 22 and 24 of the flotation device 20 to be moved toward each other to press and hold the buoyant end portions 22 and 24 against an abdominal region and a back region of the user and thereby clamp the flotation device 20 to the user. The copper tubing also enabled the buoyant end portions 22 and 24 of the flotation device 20 to be pulled away from each other to unclamp the flotation device from the user for easy removal of the flotation device.

When the clamping member 26 of the flotation device 20 is an articulated clamping member, with the articulated clamping member 26 in its normal U-shaped configuration, the buoyant portions 22 and 24 at the first and second ends of the flotation device 20 can be repeatedly moved toward and away from each other to selected positions and retained in the selected positions to clamp the flotation device 20 to and unclamp the flotation device 20 from a user's trunk. The articulated clamping member 26 would be formed of a series of segments (e.g. rigid or semi-rigid solid rod or tubular segments or rigid or semi-rigid flat narrow strip segments each about four to six inches long) that are joined together by pivot joints so that adjacent segments of the articulated clamping member could be oriented at selected angles with respect to each other to shape the clamping member into a generally U-shaped configuration. While the pivot joints of the articulated clamping member 26 would permit relative pivotal movement of the segments of the clamping member so that the clamping member 26 could be formed into a generally U-shaped configuration and the buoyant end portions 22 and 24 of the flotation device could be moved toward and away from each other to clamp and unclamp the flotation device from a user's trunk, the pivot joints would resist the relative pivotal movement of adjacent segments, e.g. through friction, radial serrations, or other conventional means, so that the segments of the articulated clamping member could be selectively retained in different positions to clamp the flotation device to and unclamp the flotation device from a user's trunk.

When the clamping member 26 of the flotation device is a resilient clamping member, the resilient clamping member 26 of the flotation device 20 retains its generally U-shaped configuration. The pliable clamping member 26 may be made from a solid rod-shaped member, a tubular member (as shown in FIGS. 4 and 5), or a narrow flat strip member. When the resilient clamping member 26 is in an unstressed state, the buoyant end portions 22 and 24 of the flotation device are a set clamping distance apart that is less than the thickness of the user's trunk. To put on the flotation device 20, the user spreads apart the buoyant end portions 22 and 24 of the flotation device 20. After the flotation device 20 is properly positioned over the user's trunk, the user releases the buoyant end portions 22 and 24 of the flotation device and the resilience of the clamping member 26 urges the buoyant end portions 22 and 24 of the flotation device 20 toward each other and into contact with the user's trunk to clamp the flotation device 20 in place.

Figure 6:
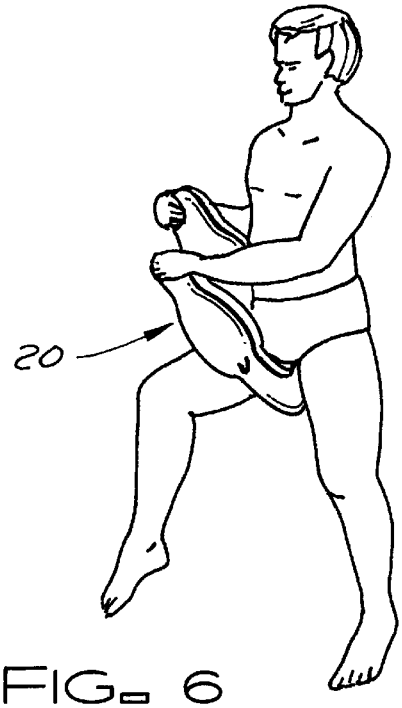
FIG. 6 is a front view showing a person putting on or taking off the flotation device of FIGS. 1 to 3.
Figure 7:
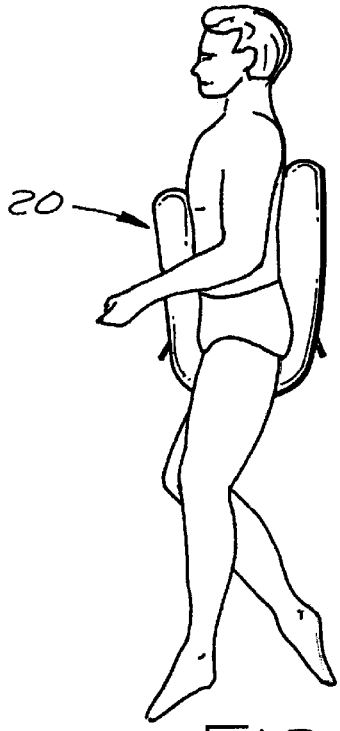
FIG. 7 is a side view showing a person wearing the flotation device of FIGS. 1 to 3.
Figure 8:
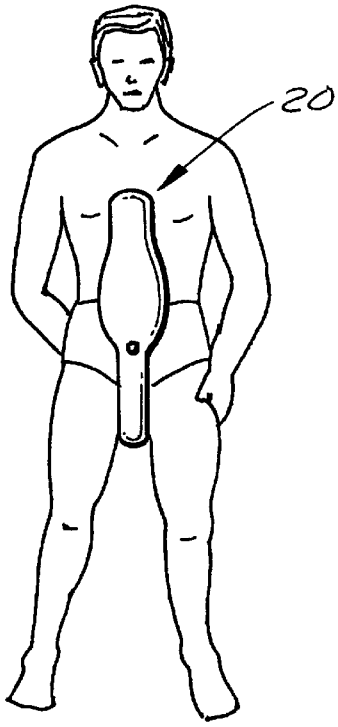
FIG. 8 is a front view showing a person wearing the flotation device of FIGS. 1 to 3.
Figure 9:
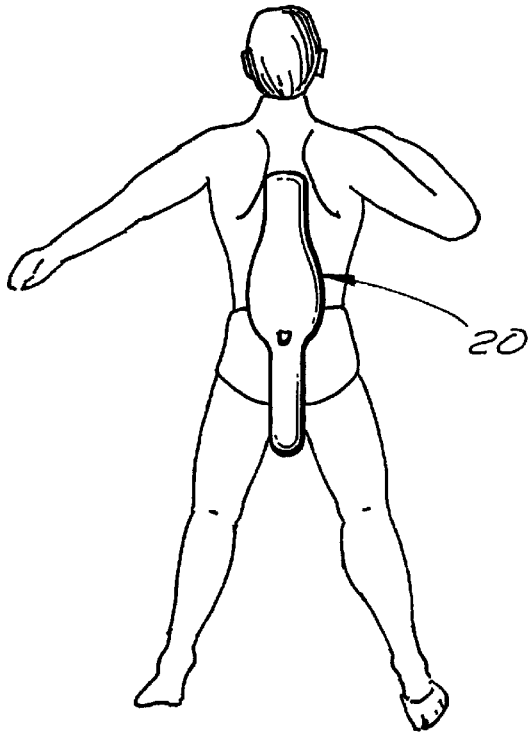
FIG. 9 is a back view showing a person wearing the flotation device of FIGS. 1 to 3.

As mentioned above, when the flotation device 20 is worn, the clamping member 26 passes from an abdominal region of a user between the upper portions of the user's legs to a back region of the user. As shown in FIG. 6, the flotation device 20 can be easily and quickly put on by passing the middle portion 28 the clamping member 26 between the user's legs and bringing the buoyant end portions 22 and 24 of the flotation device 20 into contact with an abdominal region and a back region of the user as shown in FIGS. 7, 8 and 9. With the flotation device 20 in place, the clamping member 26 presses the buoyant end portions 22 and 24 of the flotation device 20 against the abdominal and back regions of a user's trunk to clamp the flotation device 20 to the user's trunk. The clamping member 26 also permits the buoyant end portions 22 and 24 of the flotation device 20 to be moved away from each other to unclamp the flotation device 20 from a user's trunk. Thus, the user can easily and quickly put on the flotation device 20 when he/she is ready to perform a water activity and easily and quickly remove the flotation device 20 when he/she has completed his/her water activity.

When worn, the buoyant end portions 22 and 24 of the flotation device 20 are centered on regions of the user's abdomen and back and do not extend laterally beyond the person's trunk. With the buoyant end portions 22 and 24 of the flotation device not extending laterally beyond the users trunk; with the clamping member passing between the user's legs; and with no shoulder straps, waist straps or other encumbering harnesses or fastening means required to mount the flotation device on the user, the flotation device 20 does not interfere with a person's use of his/her arms and/or legs during use of the flotation device for swimming, competitive or recreational swim training, physical therapy, physical fitness, aerobics, recreation or various other water activities.

Preferably, when the flotation device 20 is worn, the buoyant end portion 22 of the flotation device 20 extends up over the upper middle abdominal region of the user, referred to as the epigastric abdominal region, to just below the rib cage so that the flotation device provides buoyancy to the user in this region and can be comfortably worn by both males and females. In fact, the upper end of the flotation portion 22 may be tapered inwardly, such as but not limited to the shape shown in FIG. 1, to better fit between the two sides of a user's rib cage where the two sides of the rib cage come together. Preferably, when the flotation device 20 is worn, the buoyant end portion 24 of the flotation device 20 extends up over the upper middle back region of user to a location between or immediately below the lower portions of the users shoulder blades so that the flotation device provides buoyancy to the user in this region and can be comfortably worn.

While less preferred for most applications, when the flotation device 20 is worn, the buoyant end portion 22 of the flotation device 20 may extend only up to and over the central abdominal region of user, referred to as the umbilical abdominal region, and the buoyant end portion 24 of the flotation device 20 may extend only up to and over the lower back region, the middle back region, or the upper back region so that the flotation device provides buoyancy to the user in these regions and can be comfortably worn by both males and females. With the buoyant end portion 22 of the flotation device 20 extending up over the upper middle abdominal region of user, referred to as the epigastric abdominal region, to just below the rib cage, the buoyant end portion 24 of the flotation device 20 may extend only up to and over the lower back region or the middle back region so that the flotation device provides buoyancy to the user in these regions and can be comfortably worn by both males and females.

Figure 10:
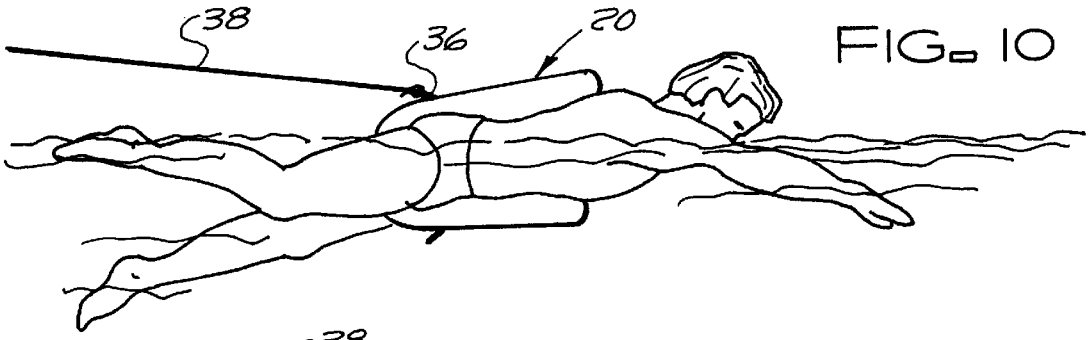
FIG. 10 is a side view showing a person wearing a tethered version of the flotation device of FIGS. 1 to 3 doing the crawl stroke.
Figure 11:
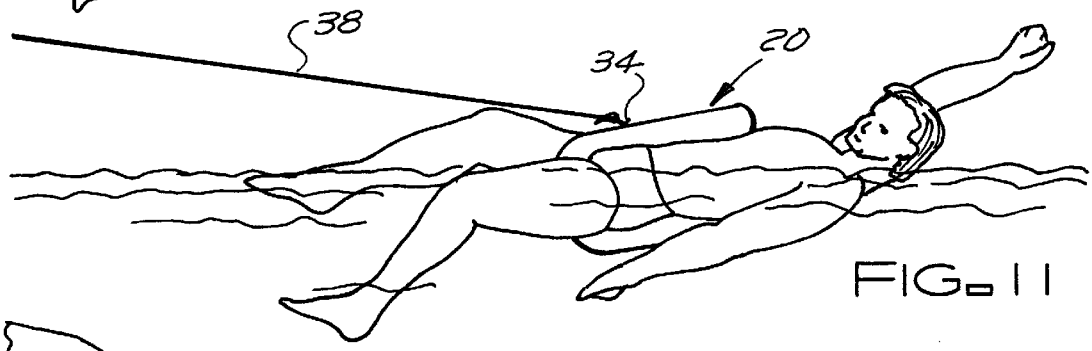
FIG. 11 is a side view showing a person wearing a tethered version of the flotation devise of FIGS. 1 to 3 doing the backstroke.
Figure 12:
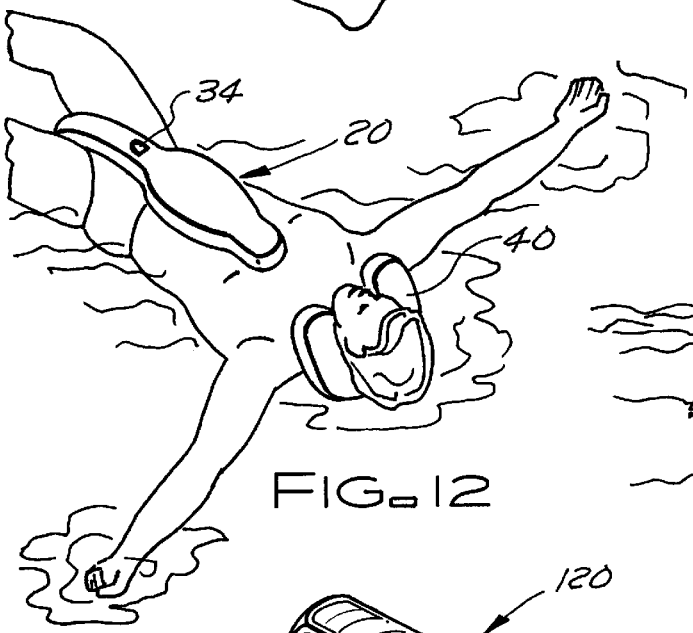
FIG. 12 is a side view from above showing a person wearing the flotation device of FIGS. 1 to 3 while floating.
Figure 13:
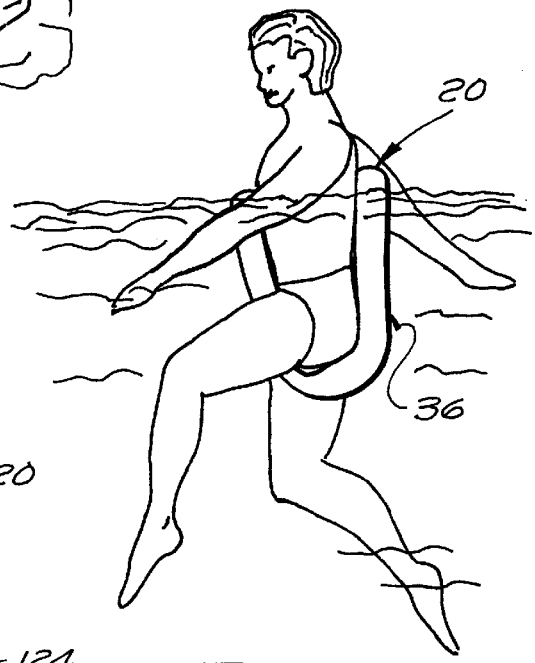
FIG. 13 is a side view showing a person wearing the flotation device of FIGS. 1 to 3 and floating while running in place.

While for most applications, the flotation device 20 will be used in an unrestricted manner to swim, train, exercise, rehabilitate, or perform other water activities. Preferably, the flotation device 20 also includes one or two connector rings 34 and 36 or other conventional connectors for connecting the flotation device 20 to a tether 38, such as shown in FIGS. 10 and 11, so that a person using the flotation device 20 can swim in place when wearing the flotation device. With the flotation device 20 clamped to a swimmer and tethered to the end or side of a pool, the flotation device 20 will maintain the swimmer in a fixed position as he/she swims and the swimmer can perform the same swimming exercises in a small backyard pool that would normally require the use of a much larger pool such as an olympic size pool. Since the flotation device 20 does not interfere with the use of the person's arms or legs, a person, with the flotation device 20 either tethered or untethered, can do any of the normal swimming strokes, such as but not limited to the crawl stroke, backstroke, breaststroke, butterfly stroke, and side stroke, plus any other stroke or exercise that comes to mind. FIGS. 12 and 13 are additional examples of two of the many applications for of the flotation device 20 where the user is not restricted by a tether. While the user is shown floating in FIG. 12 and running in place in FIG. 13, FIGS. 12 and 13 are merely illustrative of two of the many swimming, training, exercising, therapeutic and recreational applications for which the flotation device is suited and are not intended to be limiting. If desired, the flotation device 20 can be used with other swimming or training aids. For example, as shown in FIG. 12, a person floating while wearing the flotation device 20 can further relax by wearing a flotation collar 40 about his/her neck.

Figure 14:
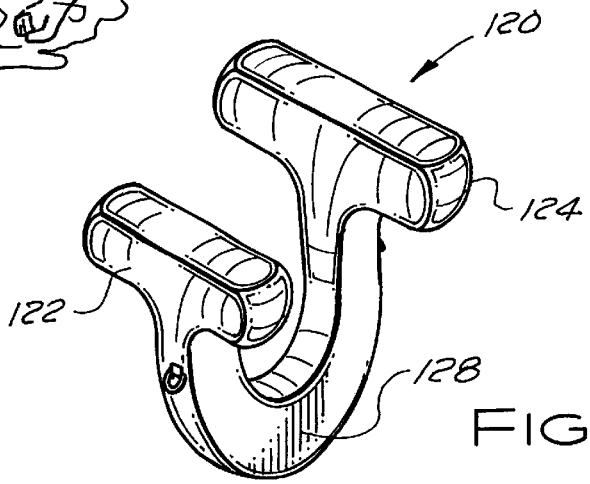
FIG. 14 is a perspective view of a second version of the flotation device of the subject invention.

FIG. 14 shows a second embodiment 120 of the flotation device subject invention. The flotation device 120 includes buoyant portions 122 and 124 at each end and a clamping member (not shown) that extends through a middle portion 128 of the flotation device 120 between and into each buoyant end portion. The flotation device 120 is the same as the flotation device 20 with the following exceptions. The buoyant end portions 122 and 124 are horizontally elongated. In addition, when the flotation device 120 is worm, the buoyant end portion 122 of the flotation device 20 rather than extending up to and over the upper middle or central abdominal regions of user, typically only extends up to and over the lower abdominal region of the user referred to as the hypograstric abdominal region while the buoyant end portion 124 of the flotation device 20 extends up to and over the lower back region, the middle back region or the upper back region of the user.

FIGS. 15 to 17 show a third embodiment 220 of the flotation device of the subject invention. The flotation device 220 includes buoyant portions 222 and 224 at each end and a generally U-shaped clamping member 226 that extends between and is integral with each buoyant end portion. The flotation device 220 is sized to fit a user in the same manner as the flotation device 20. The flotation device 220 is either water tight and hollow or, as shown in FIGS. 16 and 17 filled with a buoyant material 230 that permits the front and back arms of the generally U-shaped clamping member to be flexed. The casing 232 of the flotation device is made of a resilient polymeric material, e.g. a resilient polyethylene. The casing 232 is formed to have, in an unstressed state, a spacing between the opposed surfaces of the buoyant end portions 222 and 224 that is less than the thickness of a person's trunk that is to use the flotation device 220. The resilience of the casing 232 enables the buoyant end portions 222 and 224 to be spread apart to put the flotation device on or remove the flotation device from the trunk of a user. When the buoyant end portions 222 and 224 of the flotation device 220 are released after positioning the flotation device 220 on the user's trunk, the resilience of the casing 232 causes the buoyant end portions 222 and 224 to grip the user and clamp the flotation device to the user. Preferably, the flotation device 220 includes one or two connector rings 234 and 236 or other conventional connectors for tethering the flotation device so that a user can swim or perform other water activities in place. In addition, the middle portion of the clamping member 226 may include a recess 238 in the upper surface of the clamping member for receiving external genital organs of a user when the flotation device is worn with the clamping member in contact with the user's crotch. This same configuration may be used on the middle portions of the other embodiments of the flotation device of the subject invention.

FIG. 18 shows a fourth embodiment 320 of the flotation device of the subject invention. The flotation device 320 includes buoyant portions 322 and 324 at each end and a U-shaped multi-sectional clamping member 326 that extends between and into each buoyant end portion so that the buoyant end portions 322 and 324 move with the arms of the clamping member. The U-shaped multi-sectional clamping member 326 may include two, three or four separable and preferably, relatively adjustable sections. In the embodiment shown in FIG. 18, the multi-sectional clamping member 326 includes two end sections 342 and 344 and a generally U-shaped middle section 346 that includes a front section and a back section. Preferably, the front end section 342 of the clamping member 326 is secured to and extends from within to below the front buoyant end portion 322 of the flotation device 320 as shown in FIG. 18 or extends below and is an integral portion of the casing 332 of the front buoyant end portion 322. Preferably, the back end section 344 of the clamping member 326 is secured to and extends from within to below the back buoyant end portion 324 of the flotation device 320 as shown in FIG. 18 or extends below and is an integral portion of the casing 332 of the back buoyant end portion 324. The front section of the U-shaped middle section 346 is separably secured and may also be adjustably secured to the front end section 342 and the back section of the U-shaped middle section 346 is separably secured and may also be adjustably secured to the back end section 344 of the multi-sectional clamping member 326 by coupling or fastening mechanisms 348, e.g. conventional quick release coupling or fastening mechanisms.

As shown in FIGS. 18 and 19, the front and back sections of the U-shaped middle section 346 of the U-shaped multi-sectional clamping member 326 are adjustably secured to the two end sections 342 and 344 of the multi-sectional clamping member 326 by coupling or fastening mechanisms (such as conventional quick release coupling or fastening mechanisms 348) that permit: a) relative sliding movement (telescopic movement) between the front and back sections of the U-shaped middle section 346 and the two end sections 342 and 344; b) the selective unlocking of these sections for relative sliding movement to adjust the lengths of the arms of the U-shaped multi-sectional clamping member 326; and c) the selective locking of these sections together when the lengths of the arms of the U-shaped multi-sectional clamping member 326 are adjusted to desired lengths. As shown, the front and back sections of the U-shaped middle section 346 are also separably and adjustably secured to each other by a coupling or fastening mechanism such as the conventional quick release coupling or fastening mechanism 348. The coupling or fastening mechanism 348 in the middle section 346 permits: a) relative sliding movement (telescopic movement) between the front and rear sections of the U-shaped middle section 346; b) the selective unlocking of the front and rear sections for relative sliding movement to adjust the width of the generally U-shaped middle section 346 of the multi-sectional clamping member 326; and c) the selective locking of the front and rear sections of the U-shaped middle section 346 together when the width of the multi-sectional clamping member 326 is adjusted to a desired width. With this built in adjustability, the flotation device 320 can be adjusted to clamp the flotation device to the user and the fit of the flotation device can be adjusted to the user's liking by adjusting any one or more of the fastening mechanisms 348.

While other types of coupling or fastening mechanisms 348 may be used in the flotation device 320, FIG. 19 is an enlarged view of one type of coupling or fastening mechanism 348 that may be used in the flotation device 320. The coupling or fastening mechanism shown in FIG. 19 is a quick release coupling mechanism that can be used to separably secure the middle section 346 of the clamping member 326 to the end sections 342 and 344 of the clamping member and/or front and rear sections of the middle section 346 of the clamping member together. The quick release coupling mechanism shown includes a pair of buttons 350 in the lower end portion of end section 344 of the clamping member 326 that are biased outwardly into opposed openings 352 in the upper end portion of the middle section 346 of the clamping member 326 to secure the middle section 346 to the end section 344. The lengths of the arms of the U-shaped clamping member 326 can be adjusted by depressing the buttons 350, moving the upper end portions of the middle section 346 farther into or out of the lower end portions of the end sections 342 and 344, and letting the buttons 350 spring out to project into another set of opposed holes to again secure the middle section 346 to the end sections 342 and 344. The spacing between the arms of the U-shaped clamping member 326 can be adjusted by depressing the buttons 350 of the fastener mechanism 348, moving one of the front or rear sections of the middle section 346 farther into or out of the other section, and letting the buttons 350 spring out to project into another set of opposed holes to again secure the front and rear sections of the middle section 346 together.

Like the clamping member 26 of the flotation device 20, the clamping member 326 permits the buoyant end portions 322 and 324 of the flotation device 320 to be moved toward and away from each other between a first position where the clamping member presses the buoyant end portion 322 against an abdominal region of the user and presses the buoyant end portion 324 against a back region of the user to clamp the flotation device to the user's trunk and a second position to unclamp the flotation device from the user's trunk. Since the width of the multi-sectional generally U-shaped clamping member 326 (the spacing between the arms of the multi-sectional generally U-shaped clamping member 326) can be adjusted, the arms of the multi-sectional clamping member 326 may be rigid or substantially rigid with the flotation device 320 being clamped to the user by adjusting the width of the multi-sectional clamping device 326. However, the multi-sectional clamping member 326 of the flotation device 320 may still be a formed of pliable sections, articulated sections, or resilient sections such as those discussed in connection with the flotation device 20. In addition, the buoyant end portions 322 and 324 of the flotation device 320 may be water tight and hollow, filled with a buoyant flotation material, inflatable and deflatable, and/or integral with the end sections 342 and 344 of the clamping member 326. Preferably, the buoyant end portions 322 and 324 have an outer cover layer or casing 332 that conforms to and provides a smooth, non-irritating surface for contact with the user and a connector on each buoyant end portion, such as the connector 334, for tethering the flotation device so that a user can swim or perform other water activities in place.

As mentioned above, the generally U-shaped multi-sectional clamping member 326 may have only two sections. In this embodiment, the U-shaped multi-sectional clamping member 326 has only a front section and a back section that are separably and preferably, adjustably secured to each other in the middle portion of the U-shaped multi-sectional clamping member by a coupling or fastening mechanism such as the coupling or fastening mechanism 348. The arms of U-shaped multi-sectional clamping member are each made of one piece. In other words, this embodiment is the same as the embodiment shown in FIG. 18 with the following exception, the coupling or fastening mechanisms 348 shown in FIG. 18 separably and adjustably joining the middle section 346 of the clamping member to the end sections 342 and 344 of the clamping member are eliminated to form each of the arms of the clamping member in one piece and the coupling or fastening mechanism in the middle of middle section 346 of the clamping member is retained.

As mentioned above, the U-shaped multi-sectional clamping member 326 may have only three sections. In this embodiment, the U-shaped multi-sectional clamping member 326 has a front end section, a back end section, and a one piece middle section that are separably and preferably, adjustably secured to each other by coupling or fastening mechanisms 348. The front end of the one piece U-shaped middle section is separably secured to the front end section and the back end of the U-shaped middle section is separably secured to the back end section of the multi-sectional clamping member 326 by coupling or fastening mechanisms, e.g. conventional quick release coupling or fastening mechanisms 348. In other words, this embodiment is the same as the embodiment shown in FIG. 18 with the following exception, the coupling or fastening mechanism 348 shown in FIG. 18 separably and adjustably joining the front and back sections of the middle section 346 of the clamping member is eliminated to form middle section of the clamping member in one piece.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A flotation device to be worn for water activities, comprising:

a first buoyant portion forming a first end of the flotation device;

a second buoyant portion forming a second end of the flotation device;

a generally U-shaped clamping means extending between the first buoyant portion and the second buoyant portion for moving the first buoyant portion at the first end of the flotation device and the second buoyant portion at the second end of the flotation device toward and away from each other between a first position where the clamping means presses the first buoyant portion against an abdominal region of a user and presses the second buoyant portion against a back region of the user to thereby clamp the flotation device to the user's trunk and a second position where the first buoyant portion at the first end of the flotation device and the second buoyant portion at the second end of the flotation device are spaced from each other a greater distance than in the first position to thereby unclamp the flotation device from the user's trunk; the clamping means, when the flotation device is worn, passing from an abdominal region of the user between legs of the user to a back region of the user; and the clamping means being a multi-sectional clamping member including first and second sections that are adjustable relative to each other for moving the first buoyant portion at the first end of the flotation device and the second buoyant portion at the second end of the flotation device toward and away from each other between a first position where the clamping means presses the first buoyant portion against an abdominal region of the user and presses the second buoyant portion against a back region of the user to thereby clamp the flotation device to the user's trunk and a second position where the first buoyant portion at the first end of the flotation device and the second buoyant portion at the second end of the flotation device are spaced from each other a greater distance than in the first position to thereby unclamp the flotation device from the user's trunk.

2. The flotation device according to claim 1, wherein:

when the flotation device is worn, the clamping means is sized to pass from an abdominal region of the user between legs of the user to a back region of the user so that the first buoyant portion can be pressed into contact with an upper central abdominal region of the user and the second buoyant portion can be pressed into contact with an upper central back region of the user to thereby clamp the flotation device to the user's trunk.

3. The flotation device according to claim 1, wherein:

the first and second buoyant portions are deformable and resilient to conform to the user's trunk.

4. The flotation device according to claim 1, wherein:

a portion of the clamping means that passes between the user's legs when the flotation device is worn is padded with a deformable buoyant material.

5. The flotation device according to claim 1, including:

means for connecting the flotation device to a tether so that the user of the flotation device can swim in place when wearing the flotation device.

6. The flotation device according to claim 1, wherein:

the multi-sectional clamping member including has multiple sections that can be releaseably secured to each other.

7. The flotation device according to claim 1, including:

means on the first and on the second buoyant portions of the flotation device for connecting the flotation device to a tether so that the user of the flotation device can swim in place when wearing the flotation device.

8. A flotation device to be worn for water activities, comprising:

a first buoyant Portion forming a first end of the flotation device;

a second buoyant Portion forming a second end of the flotation device;

a generally U-shaped clamping means extending between the first buoyant portion and the second buoyant portion for moving the first buoyant portion at the first end of the flotation device and the second buoyant portion at the second end of the flotation device toward and away from each other between a first position where the clamping means presses the first buoyant portion against an abdominal region of a user and presses the second buoyant portion against a back region of the user to thereby clamp the flotation device to the user's trunk and a second position where the first buoyant portion at the first end of the flotation device and the second buoyant portion at the second end of the flotation device are spaced from each other a greater distance than in the first position to thereby unclamp the flotation device from the user's trunk; the clamping means, when the flotation device is worm, passing from an abdominal region of the user between legs of the user to a back region of the user;

the clamping means being resilient;

the first buoyant portion at the first end of the flotation device and the second buoyant portion at the second end of the flotation device are a set clamping distance apart when the clamping means is an unstressed state; and when the first buoyant portion at the first end of the flotation device and the second buoyant portion at the second end of the flotation device are spread apart, the resilience of the clamping means urges the first buoyant portion at the first end of the flotation device and the second buoyant portion at the second end of the flotation device toward each other.

9. The flotation device according to claim 8, wherein:

the clamping means is a multi-sectional clamping member including multiple sections that can be releaseably secured to each other.

10. The flotation device according to claim 8, wherein:

the first and second buoyant end portions and the clamping means of the flotation device are integral with the clamping means joining the first and second buoyant end portions; and the clamping means is a resilient casing.

11. The flotation device according to claim 10, wherein:

the first and second buoyant end portions and the clamping means of the flotation device have a buoyant flotation material therein.

12. The flotation device according to claim 10, wherein:

when the flotation device is worm, the clamping means is sized to pass from an abdominal region of the user between legs of the user to a back region of the user so that the first buoyant portion can be pressed into contact with an upper central abdominal region of the user and the second buoyant portion can be pressed into contact with an upper central back region of the user to thereby clamp the flotation device to the user's trunk.

13. The flotation device according to claim 10, including:

means on the first and on the second buoyant portions of the flotation device for connecting the flotation device to a tether so that the user of the flotation device can swim in place when wearing the flotation device.

14. A flotation device to be worn for water activities, consisting essentially of:

a first buoyant portion forming a first end of the flotation device;

a second buoyant portion forming a second end of the flotation device; and a generally U-shaped clamping means extending between and joining the first buoyant portion and the second buoyant portion of the flotation device: the generally U-shaped clamping means being the sole means joining the first buoyant portion to the second buoyant portion of the flotation device; the generally U-shaped clamping means being the sole means for moving the first buoyant portion at the first end of the flotation device and the second buoyant portion at the second end of the flotation device toward and away from each other between a first position where only the U-shaped clamping means retains and presses the first buoyant portion against an abdominal region of a user and retains and presses the second buoyant portion against a back region of the user to thereby clamp the flotation device to the user's trunk and a second position where the first buoyant portion at the first end of the flotation device and the second buoyant portion at the second end of the flotation device are spaced from each other a greater distance than in the first position to thereby unclamp the flotation device from the user's trunk; and the U-shaped clamping means, when the flotation device is worm, passing only from the first buoyant portion at an abdominal region of the user between legs of the user to the second buoyant portion at a back region of the user.

15. The flotation device according to claim 14, wherein:

the U-shaped clamping means is pliable so that the first buoyant portion at the first end of the flotation device, and the second buoyant portion at the second end of the flotation device can be repeatedly moved toward and away from each other to selected positions and retained in the selected positions to clamp the flotation device to and unclamp the flotation device from the user's trunk.

16. The flotation device according to claim 15, wherein:

the U-shaped clamping means is a multi-sectional clamping member including multiple sections that can be releaseably secured to each other.

17. The flotation device according to claim 14, wherein:

the U-shaped clamping means is resilient;

the first buoyant portion at the first end of the flotation device and the second buoyant portion at the second end of the flotation device are a set clamping distance apart when the U-shaped clamping means is an unstressed state; and when the first buoyant portion at the first end of the flotation device and the second buoyant portion at the second end of the flotation device are spread apart, the resilience of the U-shaped clamping means urges the first buoyant portion at the first end of the flotation device and the second buoyant portion at the second end of the flotation device toward each other.

18. The flotation device according to claim 17, wherein:

the U-shaped clamping means is a multi-sectional clamping member including multiple sections that can be releaseably secured to each other.

19. The flotation device according to claim 14, wherein:

the first and second buoyant portions of the flotation device are sized to have a maximum horizontal width less than a preselected width which is to be a minimum width of the user's trunk so that the first and second buoyant portions do not extend laterally beyond the user's trunk.

20. The flotation device according to claim 14, including:

means on the first and on the second buoyant portions of the flotation device for connecting the flotation device to a tether so that the user of the flotation device can swim in place when wearing the flotation device.

* * * * *